United States Patent [19]

Eguchi et al.

[11] Patent Number: 4,724,569

[45] Date of Patent: Feb. 16, 1988

[54] TOOTHBRUSH

[75] Inventors: Yasuteru Eguchi; Satoshi Tsujita, both of Utsunomiya, Japan

[73] Assignee: Kao Corporation, Tokyo, Japan

[21] Appl. No.: 868,591

[22] Filed: May 30, 1986

[51] Int. Cl.[4] ..... A46B 9/04

[52] U.S. Cl. ..... 15/167.1; 15/DIG. 5; 128/62 A

[58] Field of Search ..... 15/186, 187, 188, 167 R, 15/167 A, 110, DIG. 5; 128/62 A

[56] References Cited

U.S. PATENT DOCUMENTS 4,161,050 7/1979 Sasaki et al. ..... 15/159 A

FOREIGN PATENT DOCUMENTS 1083781 6/1960 Fed. Rep. of Germany ... 15/159 A
1253668 11/1967 Fed. Rep. of Germany ..... 15/187
3116189 12/1982 Fed. Rep. of Germany .... 15/167 R
3433763 2/1986 Fed. Rep. of Germany .... 15/167 R
333001 5/1959 Switzerland ..... 15/167 R
2035076 6/1980 United Kingdom ..... 15/187

*Primary Examiner*—Peter Feldman
*Attorney, Agent, or Firm*—Birch, Stewart, Kolasch & Birch

[57] ABSTRACT

A toothbrush capable of removing the sordes from the teeth excellently, and massaging the gums effectively without paining or hurting the same. The toothbrush has a handle, and bristles implanted into the handle, characterized in that all of the bristles have spherical portions formed at the free ends thereof, these bristles consisting of bristles of not less than two kinds of lengths, a difference between the length of the longest bristles and that of the shortest bristles being within the range of 1–4 mm, the bristles being arranged in such an implantation pattern that the bristles of an equal length do not gather locally so as to prevent the spherical portions thereof from contacting one another, whereby these bristles are not bent outward.

5 Claims, 2 Drawing Figures

FIG. 1
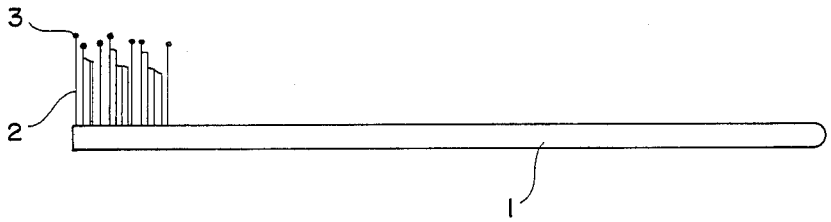
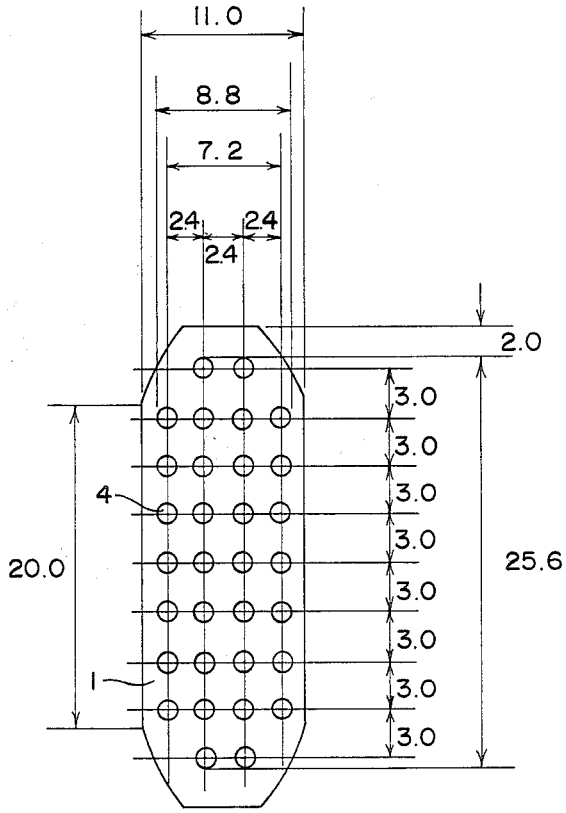
FIG. 2

TOOTHBRUSH

FIELD OF THE INVENTION

The invention relates to a toothbrush. The toothbrush of the invention provides an improved effect in removing dental plaque and is effective to massage the gums, not hurting it. The massaging of the gums is agreeable to the user.

DESCRIPTION OF THE PRIOR ART

In a toothbrush used in our daily lives, the material for, and the thickness, length and implantation pattern, of the bristles, and the material for and the shape of a handle are determined selectively so that mainly the dirt on the surfaces of the teeth, i.e. sordes can be efficiently removed.

It is known that a toothbrush has a gum masssaging effect in addition to the sordes removing effect. Komori et al (Bulletin of Japan Society of Dental Pathology, 20, 246–259, 1974) proved by experiments using monkeys that, if gums are massaged with a toothbrush, the gingivitis can be prevented.

In spite of the fact that a toothbrush has such a very large gum massaging effect, the regular toothbrushes commercially available at present are rarely so designed as to improve their gum massaging effects. There are no other toothbrushes designed with the intention, if any, of improving the gum massaging effects thereof than a toothbrush the ends of the bristles of which are rounded so as to prevent the gums from being hurt when the ends of the bristles contact the same while the teeth are cleaned.

There are commercially-available toothbrushes to be used for gum massaging purpose only, though the number of them is extremely small. In these toothbrushes, very soft bristles are implanted into the handle thereof so that the gums do not pain when the bristles are applied thereto, or rubber tips instead of bristles are attached to the handle. Therefore, it is impossible to expect such toothbrushes to have a sufficiently large sordes removing effect. In view of the fact that sordes directly cause not only caries but also gingivities and alveolar pyorrhea to occur, it can necessarily be said that these gum messaging toothbrushes are too defective to be used for the prevention of gingivitis.

Japanese Utility Model Laid-open No. 76768/1976 discloses a toothbrush, in which the bristles of equal length having small balls at the free end portions thereof are implanted into a handle thereof. In this type of toothbrush, the level of the force required to insert the free end portions of the bristles into a space between two adjacent teeth, in which it is the most difficult to remove the sordes, is substantially equal to that of the force required to insert the free end portions of the bristles of a conventional toothbrush into a similar space. Hence, the toothbrush disclosed in this publication has no special advantages in this respect. Moreover, since the toothbrush has bristles of equal length, the end of each bristle contacts a tooth in a simple pattern. Accordingly, when a person, who moves a toothbrush in a particular way while he cleans his teeth, uses this toothbrush, the free ends of the bristles thereof would not contact some parts of the teeth.

SUMMARY OF THE INVENTION

An object of the present invention is to provide a novel toothbrush capable of inserting the free end portions of the bristles thereof between two adjacent teeth easily, having excellent sordes removing and gum massaging effects, and is agreeable to a user while using the toothbrush. Sordes or dental plaque can be effectively cleaned out with the tooth brush of the invention.

For this purpose, the invention provides a toothbrush in which a difference between the maximum and minimum lengths of the bristles is in the range of 1–4 mm, all the bristles being provided with spherical portions at their free ends, these bristles consisting of bristles of not less than two or three different lengths implanted into a handle. The various problems mentioned in the previous paragraphs can be solved by limiting the mode of the bristles in this manner.

The above and other objects as well as advantageous features of the invention will become apparent from the following description of the preferred embodiments taken in conjunction with the accompanying drawings.

BRIEF DESCRIPTION OF THE DRAWINGS

FIG. 1 is a schematic side elevation of an embodiment of the toothbrush according to the present invention; and FIG. 2 shows a bristle implantation pattern in the embodiment.

DESCRIPTION OF THE PREFERRED EMBODIMENTS

The toothbrush according to the present invention is formed by implanting bristles which have spherical portions at the free ends thereof, and which are made to not less than two different lengths, into a handle. The upper limit of the number of kinds of lengths of the bristles is not specially determined. If the number of kinds of lengths of the bristles is increased so that the distribution of the kinds of lengths thereof becomes as uniform as possible, i.e., not one-sided, the possibility of the occurrence of the partial abrasion of the free ends of the bristles decreases.

Concerning the lengths of the adjacent bristles on the same handle, it is preferable that the lengths of not less than 50% of a plurality of bristles which are adjacent to one arbitrary bristle be different from that of the single bristle. If this single bristle has a plurality of adjacent bristles of a length equal to that thereof, the spherical portions of the bristles contact one another, and the free end portions of the bristles are inclined outward, so that the external appearance of the bristles is spoiled.

The toothbrush according to the present invention has a characteristic mode of arrangement of bristles, and spherical portions are formed at the free ends of all of the bristles. The difference between the length of the longest bristles and those of the shortest bristles is in the range of 1–4 mm. It is necessary that the number of kinds of the lengths of these bristles be not less than two or three.

Since the spherical portions formed at the free ends of all the bristles have sordes removing effect, the toothbrush according to the present invention has a larger sordes removing effect than a regular type of toothbrush. Since the bristles in the toothbrush according to the present invention are formed to various lengths the differences among which are within the range of 1–4 mm, the free end portions thereof easily enter a space between two adjacent teeth, in which it is difficult to remove sordes from the teeth, so that the sordes removing effect of this toothbrush in such a space is far greater than that of a regular toothbrush. According to the present invention, the free end of any one of the bristles always contact a tooth during the cleaning of the teeth irrespective of the magnitude of the force applied to the bristles in motion, the kind of tooth (molar tooth, premolar tooth, canine and incisor), and the position of tooth. Therefore, sordes can be removed completely, so that a so-called uncleaned part of a tooth does not remain.

The gum massaging effect of toothbrushes will now be discussed. The bristles in a toothbrush, which have spherical portions at the free ends thereof, and which are formed to an equal length contact the gums more softly than those in a regular type of toothbrush, which are rounded at the free ends thereof and formed to an equal length but the former bristles pain the gums in some cases. It is considered that the reason why these bristles pain the gums resides in that the free ends of all the bristles contact the gums. If spherical portions are formed at the free ends of all the bristles with the bristles set to various lengths as in the toothbrush according to the present invention, the free ends of the bristles contact the gums moderately. Therefore, even if the teeth are cleaned with considerably great force, the gums do not pain.

As described above, in the toothbrush according to the present invention, it is necessary that the difference between the length of the longest bristles and that of the shortest bristles be within the range of 1–4 mm. When this difference is less than 1 mm, the bristles extend substantially in the same manner as those in a brush-tooth, which are formed to an equal length. Such bristles have neither a sufficient sordes removing effect nor a sufficient gum massaging effect. When this difference exceeds 4 mm, the shortest bristles substantially do not contact the teeth and gums. Hence the bristles including such shortest bristles are substantially identical with the implanted bristles of reduced density. Such bristles also have insufficient sordes removing and gum massaging effects.

The present invention will further be described with reference to the diameter of the bristles. The diameter of the portion of a bristle which excludes its free end portion, i.e. a non-spherical portion of a bristle is suitably around 6/1000–15/1000 inch. When the diameter of the bristles is less than 6/1000 inch, the firmness of the bristles is lost, and the sordes removing and gum massaging force applied thereto during the cleaning of the teeth would not effectively work. If the tooth-cleaning force is then increased, the bristles would be bent or the gums would be hurt. When the diameter of the bristles exceeds 15/1000 inch, the firmness of the bristles becomes too high, so that they contact the gums unpleasantly. A specially preferable diameter of the bristles is 6/1000–11/1000 inch.

On the other hand, the diameter (maximum diameter) of the spherical portion at the free end of a bristle is suitably about 1.1–2.5 times as large as that of the other portion thereof, and preferable about 1.2–2.0 times as large as the same. When the diameter of the spherical portions of the bristles is less than 1.1 times that of the other portions thereof, these bristles are substantially identical with the bristles having no spherical portions in a regular type toothbrush, and do not have a sufficient practical effect. When the diameter of the spherical portions exceeds 2.5 times that of the other portions of the bristles, the free end portions of the bristles are inclined outward to spoil the external appearance thereof, and cause the commercial value of the toothbrush to decrease greatly.

The spherical portion formed at the free end of the bristle is not necessarily made spherical. It may also be made elliptical, nail-shaped, rectangularly-shaped with the four corners rounded, square and trapezoidal. The pattern of implanting bristles of not less than two or three kinds of lengths is not specially limited. The bristles are preferably implanted according to a pattern in which bristles of different lengths are suitably distributed, i.e. a pattern in which the bristles of the same or substantially the same length do not locally gather.

The number of the bores into which the bristles are implanted is generally 20–30, and the number of the bristles implanted into one bore 30–60. These numbers do not limit the characteristics of the present invention. In addition, the material for the bristles is not specially limited. The materials of which the bristles in the conventional toothbrushes are made can be used in the present invention. The nylon which is now widely used can also be employed.

EMBODIMENT

The toothbrush according to the present invention will now be described with reference to its embodiment. The toothbrush described hereinbelow is only an example of the present invention. The lengths of the bristles, the difference between the length of the longest bristles and that of the shortest bristles, the condition of distribution of the bristles of different lengths and the implantation pattern of the bristles are not limited to those in the embodiment which will now be described.

A toothbrush according to the present invention is shown in schematic side elevation in FIG. 1. Referring to FIG. 1, reference numeral 1 denotes a handle, 2 bristles, and 3 spherical portions at the free ends of the bristles. As shown in FIG. 1, the bristles consist of bristles of larger and smaller lengths. The distribution of the lengths of the bristles is as follows.

Distribution of the lengths of the bristles

| Length of the bristles | Distribution (%) |
|---|---|
| 9.0–9.9 | 10.1 |
| 10.0–10.9 | 58.3 |
| 11.0–11.9 | 30.3 |
| 12.0–12.4 | 1.3 |
| Total: | 100.0 |
| Length of the longest bristles: | 12.0 mm |
| Length of the shortest bristles: | 9.1 mm |
| Difference between the lengths of the longest and shortest bristles: | 2.9 mm |

The diameter of the portion of each bristle which is other than the free end portion thereof was 8/1000 inch, and the diameter of the spherical portion at the free end of each bristle 1.3–1.8 times that of the non-spherical portion thereof.

The implantation pattern of these bristles was as shown in FIG. 2. Referring to this drawing, reference numeral 4 denotes bores into which the bristles are implanted, and the unit of the measurements shown by smaller numerals is millimeter.

The diameter of each bore 4 was 1.6 mm, and forth bristles were implanted into each bristle. The distribution of the lengths of the bristles, which is shown above, was determined with respect to all of the bristles implanted into a total of thirty-two bores.

Embodiment and Comparative Examples

In accordance with the bristle implantation pattern of FIG. 2, the following four types of toothbrushes were prepared, and a test was conducted, in which the magnitude of the force applied to the teeth or gums was measured with respect to each type of brush. The results are shown in Table 1.

Toothbrush A: The length of the bristles was set equal. The corners of the free ends of the bristles were rounded. The bristles had a diameter of 8/1000 inch.

Toothbrush B: Bristles of larger and smaller lengths were implanted. The corners of the free ends of the bristles were rounded. The bristles had a diameter of 8/1000 inch.

Toothbrush C: Spherical portions were formed at the free ends of the bristles. The length of the bristle was set equal. The portion of each bristle which is other than the spherical portion thereof had a diameter of 8/1000 inch.

Toothbrush D: Toothbrush according to the present invention having the previously-mentioned distribution of bristles.

TABLE 1

| Type of toothbrush | Average[a] load on toothbrush | Value of[b] measured pressure | Pressure due[c] to 1 kg load on toothbrush |
|---|---|---|---|
| A | 1.13 kg | 0.064 kg/cm$^2$ | 0.057 kg/cm$^2$ |
| B | 1.17 | 0.083 | 0.071 |
| C | 1.18 | 0.109 | 0.092 |
| D | 1.20 | 0.135 | 0.113 |

Testing method

A load (average load on toothbrush a on Table 1) of about 1 kg is applied to a toothbrush as a whole to read the value (value of measured pressure b on Table 1) appearing on the pressure-sensitive paper. This value represents the pressure applied to the teeth and gums via the bristles. The pressure c due to the 1 kg load on the toothbrush is determined by dividing b by a.

When the value c is large, it means that a high pressure is applied to the teeth and gums with a smaller tooth-cleaning force, and that a toothbrush having such a large value c has excellent sordes removing and gum massaging effects. It is understood from Table 1 that the toothbrush according to the present invention is superior to the other toothbrushes.

The present invention is not, of course, limited to the above embodiment; it may be modified in various ways within the scope of the appended claims.

What is claimed is:

1. A toothbrush comprising a handle, bores and bristles implanted into said bores, said bristles having a diameter of from 6/1000 to 15/1000 of an inch and having a free spherical end portion with a diameter of from 1.1 to 2.5 times the bristle diameter, said bristles being a mixture of longer and shorter bristles wherein the length difference between said longer and shorter bristles is within the range of from 1 to 4 mm, and wherein the lengths of 50% or greater of said bristles which are adjacent to any one arbitrary bristle are of a different length to said arbitrary bristle.

2. A toothbrush according to claim 1 having 20 to 30 bores.

3. A toothbrush according to claim 1 having 30 to 60 bristles implanted into each of said bores.

4. A toothbrush according to claim 1 wherein said bristles have a bristle density range of from 417 to 833 bristles/cm$^2$.

5. A toothbrush according to claim 1 wherein said bristles have lengths of from 9.1 to 12.0 mm.

* * * * *